United States Patent [19]

Picollo

[11] Patent Number: 4,637,585

[45] Date of Patent: Jan. 20, 1987

[54] REUSABLE CONCRETE CURB INLET FORM

[76] Inventor: August J. Picollo, 628 Beebe Rd., Central Point, Oreg. 97501

[21] Appl. No.: 723,613

[22] Filed: Apr. 15, 1985

[51] Int. Cl.[4] ..... B28B 7/30; E01C 19/50; E02D 29/12

[52] U.S. Cl. ..... 249/10; 249/83; 249/91; 249/145; 249/180; 249/184; 404/5

[58] Field of Search ..... 249/1, 2, 10, 11, 100, 249/83, 91, 184, 180, 175, 152, 145, 146, 163; 404/4, 5

[56] References Cited

U.S. PATENT DOCUMENTS

| | | | |
|---|---|---|---|
| 926,231 | 6/1909 | Barber | 249/184 |
| 2,809,414 | 10/1957 | Mitchell | 249/2 |
| 3,436,051 | 4/1969 | Nakahara | 249/1 |
| 3,847,339 | 11/1974 | Farrell | 249/1 |
| 4,061,434 | 12/1977 | Carroll | 404/4 |
| 4,085,918 | 4/1978 | Wilkerson | 249/11 |
| 4,119,291 | 10/1978 | Polito | 249/11 |
| 4,192,625 | 3/1980 | Peletz | 404/5 |
| 4,536,103 | 8/1985 | Prescott | 249/11 |

FOREIGN PATENT DOCUMENTS

| | | | |
|---|---|---|---|
| 2549721 | 5/1977 | Fed. Rep. of Germany | 249/100 |
| 1314 | of 1898 | United Kingdom | 249/180 |

*Primary Examiner*—Jay H. Woo
*Assistant Examiner*—James C. Housel
*Attorney, Agent, or Firm*—Klarquist, Sparkman, Campbell, Leigh & Whinston

[57] ABSTRACT

A reusable form for manufacturing curb inlet drains in situ includes a central tapered key section to which drain forming elements are detachably secured. A lid section is also attached to the key section. The drain forming elements each have a generally horizontal shelf with an upwardly projecting curved neck flange segment. These segments form a circular neck which abuts the underside of the lid section when the form is assembled. The front drain forming elements define a mouth for the curb inlet drain. Except for the mouth, the sides of the form are closed by plates extending downwardly from the shelves. Following the formation of a curb inlet drain, the lid section is removed. In addition, the drain forming elements are detached and the key section is removed upwardly through a manhole opening of the curb inlet drain. Then, the drain forming elements are also removed upwardly through the manhole opening. The lid section is expandable to selectively engage a rim which remains as a part of the curb inlet drain. In addition, nosing retainer mechanisms are provided for holding a nosing piece in place while the curb inlet drain is formed.

16 Claims, 6 Drawing Figures

REUSABLE CONCRETE CURB INLET FORM

BACKGROUND OF THE INVENTION

The present invention relates to forms for use in manufacturing curb inlet drains for streets and the like. More particularly, the present invention relates to a reusable form for use in casting concrete curb inlet drains in situ.

One known prior art curb inlet drain form is of one piece and is fabricated out of fiberglass. These forms are positioned at the desired location of a curb inlet drain, concrete is poured around them to form the drain, and the forms are left in place. The form is not needed for structural strength, but simply cannot be readily removed. Such forms are presently made by a relatively few manufacturers and must be shipped to a contractor or other user at a construction site. This requires lead time and subjects the user to limitations on the ability of the manufacturers to meet demand. Moreover, at this time, such forms typically cost several hundred dollars and because the forms are not reusable, such costs add to the price of a construction project.

In some localities, curb inlet drains are cast from on-site fabricated forms. Such forms are typically very costly because of the labor and time needed to construct them. These forms are usually made of exterior plywood which is oiled to permit removal of the form after the concrete has set. Also, such forms are typically destroyed in the process of removing them.

Another known approach is to utilize precast concrete curb inlet drains. To make a precast drain, concrete is poured into a mold which shapes the outer exterior surfaces of the drain. Precast drains typically are extremely heavy, for example, about five hundred pounds. For this reason, they cannot be readily handled without special equipment such as a boom truck. Also, the cost of shipping such precast curb inlet drains to a construction site is high. In addition, these precast drains are sometimes difficult to install, for example to place them level, because of their weight. In addition, because the precast curb inlet drains are typically manufactured away from a construction site, it is difficult for the precast drain to match adjacent concrete which is poured at the site. For example, some differences in texture and coloration may be present which detract from the appearance of the completed construction project. Also, the face of the curb in different localities varies from sloped to vertical. It is sometimes difficult to order precast concrete drain inlets with a curb face which meets the requirements of a particular construction project.

Still another prior art apparatus for forming concrete curb openings is shown in U.S. Pat. No. 2,809,414 of Mitchell. Mitchell discloses a form used in pouring concrete curb inlet openings in situ. Specifically, Mitchell is understood to describe a multi-piece form with pieces which are bolted together to complete the form. This form is removed for reuse by loosening the bolts, where necessary, to disassemble the form and permit its removal after the curb inlet drain has been poured and set sufficiently. In Mitchell, a plate 50 is removed through the mouth of the curb inlet while other pieces are apparently lifted upwardly through a man hole opening formed by the form. Also, in Mitchell, a peripheral form piece is provided for forming a recess or a man hole cover. It appears that the Mitchell form is somewhat time consuming to install and remove.

Therefore, a need exists for an improved apparatus for forming curb inlet drains in situ which is directed towards overcoming these and other disadvantages of prior art devices.

SUMMARY OF THE INVENTION

The present invention comprises a reusable concrete curb inlet drain form for use in casting curb inlet drains in situ. The form includes a central key section having sides to which curb inlet drain forming elements are detachably secured. A manhole opening forming or lid section of the form is mounted to the top of the key section as well. Following the construction of a curb inlet drain, the lid section is removed, the key section is removed, and each of the curb inlet drain forming elements are also removed. The key section and the curb inlet drain forming elements are removed upwardly through the formed man hole opening.

In accordance with a more specific aspect of the invention, the key section comprises a frame of an inverted truncated pyramidal shape. With this shape, removal of the key section upwardly through the man hole opening is easily accomplished following the detachment of the inlet drain forming elements.

As still another aspect of the present invention, the man hole opening forming or lid section of the form includes means for movement into and out of engagement with a man hole bounding rim. Such means engages the rim while the curb inlet drain is poured. Thereafter, such means disengages the rim so that the lid section may be removed while leaving the rim in place as part of the formed curb inlet drain. As a more specific aspect of this latter feature of the present invention, the man hole forming section comprises first and second generally semi-circular planar plates which are selectively movable toward and away from one another. A rim engaging means, such as a split-ring mounted to the plates, release and grip the rim as the plates move.

As still another feature of the present invention, the form includes a mechanism for supporting a curb inlet drain nosing in place while concrete is being poured. This mechanism releases the nosing following the pouring of the curb inlet drain. Consequently, when the form is removed, the nosing remains as part of the curb inlet drain for reinforcing purposes.

It is accordingly an overall object of the present invention to provide an improved reusable form for manufacturing curb drain inlets in situ.

It is still another object of the present invention to provide such a form which is relatively inexpensive and durable.

A further object of the present invention is to provide such a form which is easy and fast to install and remove.

Still another object of the present invention is to provide such a form which may be installed and removed by a single individual without requiring a boom truck or other expensive load handling equipment.

These and other objects, features and advantages of the present invention will become apparent with reference to the following description and drawings.

DETAILED DESCRIPTION OF A PREFERRED EMBODIMENT

Figure 1:
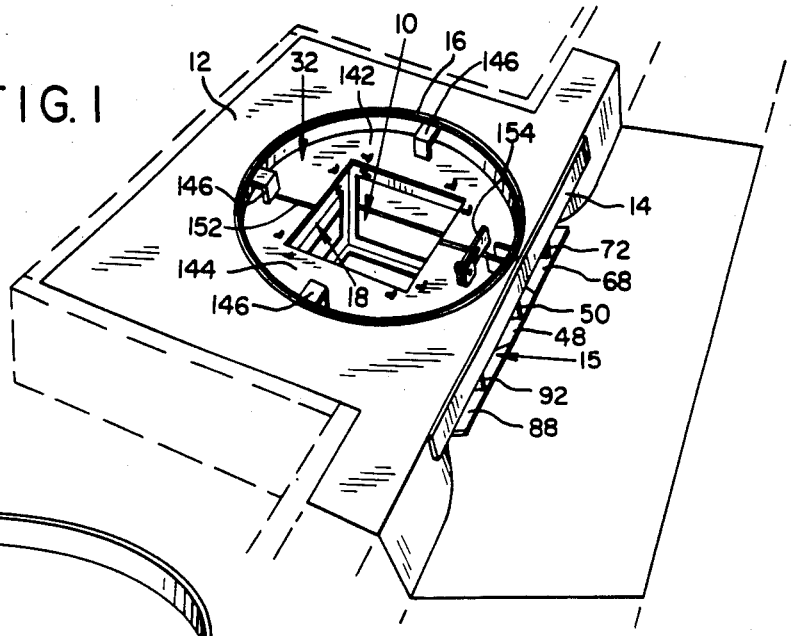
FIG. 1 is an isometric view of a concrete curb inlet drain form in accordance with the present invention in place, with concrete poured about the form to provide a curb inlet drain.

With reference to the figures, and in particular to FIG. 1, the illustrated curb inlet drain form 10 is shown in place with concrete 12 poured about the form. After the concrete is set, the form 10 is removed, as explained below, leaving the concrete curb inlet drain cast in place. When the form 10 is removed, a piece of angle iron nosing 14 and a metal man hole cover supporting rim 16 remain in place, embedded in the concrete. Pins 13 project from the rear of the nosing and into the concrete to anchor the nosing. Except for the nosing and rim, the entire form 10 is removed for use in manufacturing a subsequent curb inlet drain.

Figure 3:
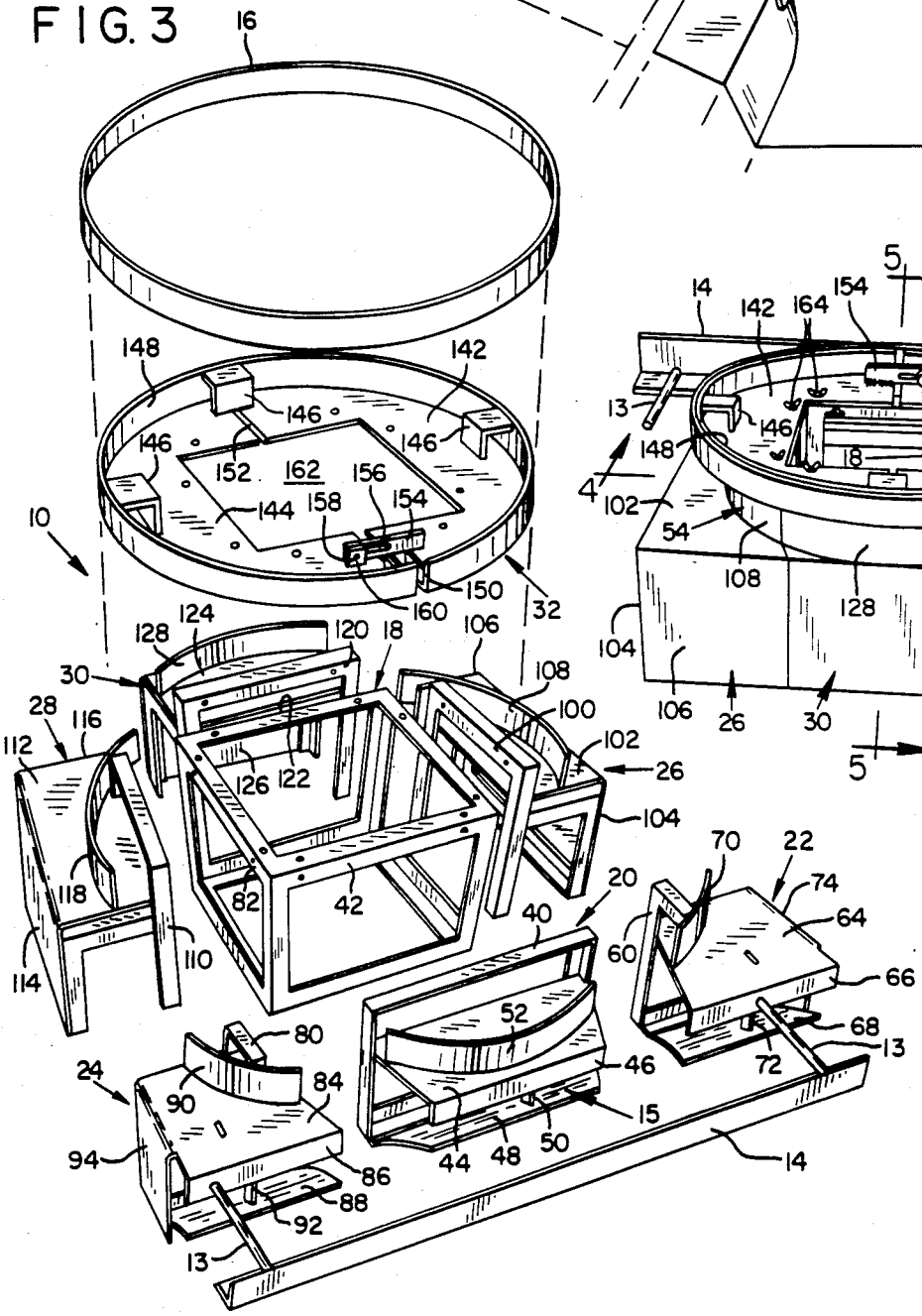
FIG. 3 is an exploded view of the form of FIG. 2 showing the form in a disassembled condition.
Figure 2:
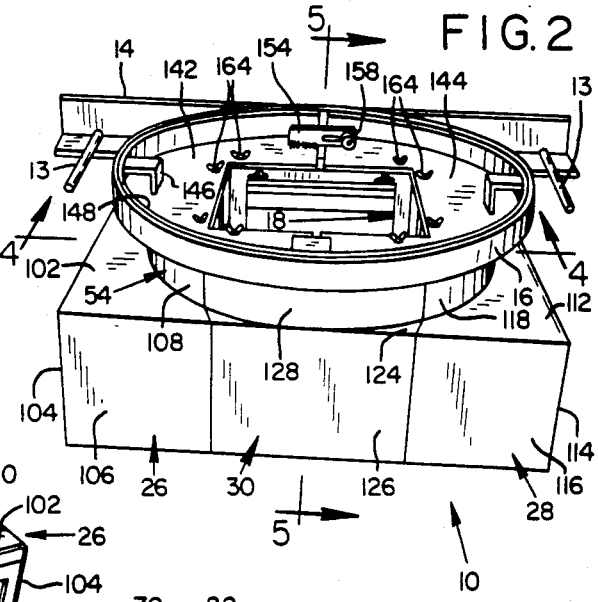
FIG. 2 is an isometric view of the form of FIG. 1 in an assembled condition prior to the pouring of concrete.

As best seen in FIGS. 2 and 3, the form 10 includes a central key section 18, to which plural curb inlet drain forming elements are detachably secured. These elements include a front central element 20, front corner elements 22, 24, side elements 26, 28 and a rear curb inlet drain forming element 30. In addition, the form includes a man hole cover opening forming or lid section 32.

More specifically, in the illustrated embodiment, the key section 18 comprises a hollow framework in the shape of an inverted truncated pyramid. That is, the sides of key section 18 slope inwardly from the top to the bottom of the key section. This permits the easy removal of the key section 18 upwardly away from the drain forming elements 20 through 30 when such elements are disconnected from the key section following the pouring of a curb inlet drain.

The front central curb inlet drain forming element 20 is provided with a rear wall or frame 40 which abuts the side 42 of key section 18 when the apparatus is assembled, as by bolting the wall 40 to the side 42. The front central drain forming element 20 includes a shelf 44 which extends transversely from side edge to side edge of wall 40 and which projects outwardly from the wall 40. The shelf 44 terminates in a downturned reinforcing flange 46. In addition, shelf 44 is tapered or narrows moving outwardly from the wall 40. This facilitates removal of drain forming element 20 after a curb inlet drain is poured, as explained below. A curved mouth forming flange 48 extends upwardly and outwardly from the lower edge of the wall 40. The flange 48 forms the bottom region of a mouth 15 leading to the interior of the curb inlet drain. Like shelf 44, the plate 48 tapers inwardly moving away from the wall 40 to facilitate its removal from a poured curb inlet drain.

Figure 5:
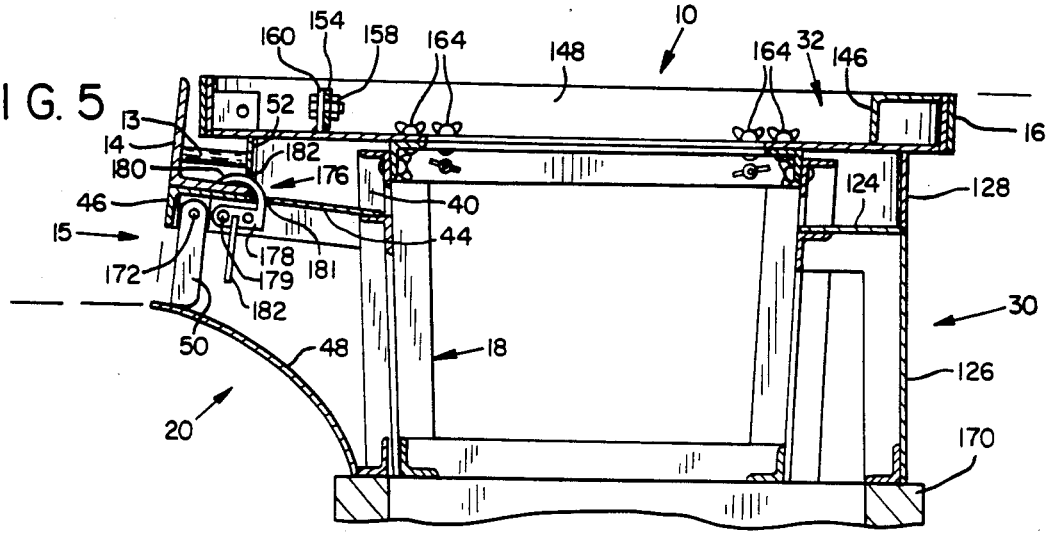
FIG. 5 is a vertical sectional view of the form of FIG. 2, taken along lines 5—5 of FIG. 2.

A spacer 50, explained in greater detail below in connection with FIG. 5, maintains the spacing between the shelf 44 and plate 48 to rigidify these elements while the concrete is poured. In addition, a curved flange 52, which forms a segment of a circular neck 54 (FIG. 2) of the form, projects upwardly from the upper surface of the shelf 44. Neck 54 assists in forming the manhole opening leading to the interior of the finished curb inlet drain and also provides partial support to the lid section 32. The portions of the shelf 44 projecting outwardly beyond the neck segment 52 support the nosing 14, as shown in FIG. 5, and also concrete poured between the nosing and the rim 16.

In a similar manner, the front corner element 22 includes a wall or frame 60 which abuts and is fastened to a side 62 of the key section 18. Element 22 includes a generally horizontal shelf 64 which terminates along its front edge in a downturned flange 66. In addition, a curved mouth forming flange 68 extends upwardly and forwardly from a lower edge of the wall 60. The interior side edges of the shelf 64 and mouth forming flange 68 flare or widen moving outwardly from the wall 60. That is, these side edges are shaped to abut the respective side edges of the shelf 44 lower curved flange 48. In addition, a curved flange 70 projects upwardly from shelf 64 and forms another segment of the circular neck 54. Flange 70 abuts the flange 52 when the form is assembled. Also, a spacer mechanism 72, like mechanism 50, extends from the underside of shelf 64 to the upper surface of curved flange 68 for reinforcing purposes. Finally, the exterior side of the drain forming element 22 is closed by a plate 74 which extends downwardly from shelf 64 and prevents concrete from running into the mouth from the side of element 22.

Figure 6:
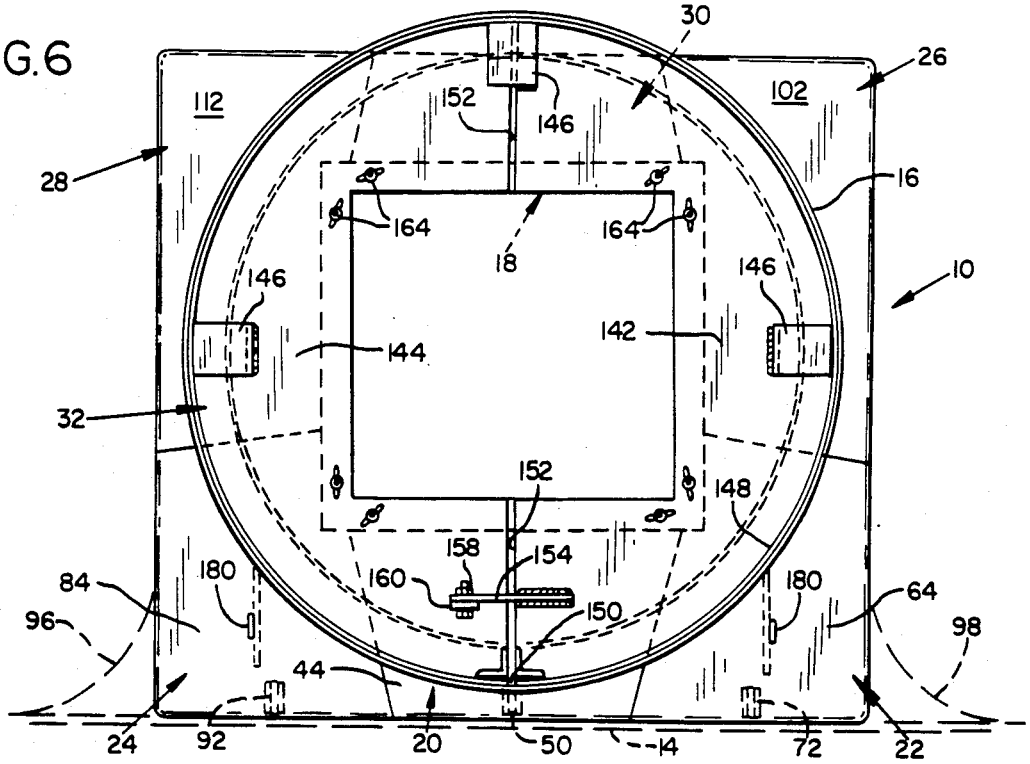
FIG. 6 is a top plan view of the form of FIG. 2.

The form element 24 is a mirror image of the element 22. As such, it includes a wall section 80 for attachment to the side 82 of the key section 18. In addition, it includes a shelf 84, downturned front flange 86, lower curved mouth forming flange 88 and a curved neck forming segment 90. The interior side edges of shelf 84, flange 86 and mouth forming flange 88 abut the adjacent side edges of shelf 44, flange 46 and lower curved flange 48. Also, form element 24 includes a spacer mechanism 92, like the spacer mechanism 50, as well as a side wall plate 94. When assembled, these sections appear as shown in FIG. 6. Also, with reference to FIG. 6, to provide a smooth transition leading to the mouth 15 of the curb inlet drain, curved sheet metal elements 96, 98 are utilized to shape the curb at the entrance to the mouth.

The drain forming side elements 26 and 28 are also mirror images of one another. The element 26 includes a rear wall 100 which abuts and is secured to the side 62 of the key section 18 when the form is assembled. A generally horizontal shelf 102 projects outwardly from the wall 100 and a side plate 104 projects downwardly from the outer edge of shelf 102. Another plate 106, best seen in FIG. 2, projects downwardly from the rear edge of shelf 102 and closes the rear end of the element 26. In addition, a curved flange 108 projects upwardly from the shelf 102 and comprises still another segment of neck 54. In the same manner, the drain forming element 28 includes a wall 110 which is fastened to the side 82, a generally horizontal shelf 112, downwardly extending side and end plates 114, 116 and a curved neck forming flange segment 118.

Finally, the rear drain forming element 30 includes a wall 120 which is fastened to the rear side 122 of the key section 18. Like the other drain forming elements, drain forming element 30 includes an outwardly projecting generally horizontal shelf 124 to which a downwardly extending plate 126 is fastened. In addition, a curved neck forming flange segment 128 projects upwardly from the shelf 124. The shelf 124 is tapered moving outwardly from wall 120 to facilitate removal of the element 30 following the pouring of a concrete curb inlet drain.

As is apparent from FIGS. 2 and 3, the plates 74, 104, 106, 126, 116, 114 and 94 form the side walls of a closed rectangular box-like structure which prevents concrete from flowing to the interior of the curb inlet drain. In addition, the shelves 64, 102, 124, 112, 84 and 44 close the top of this box-like structure to prevent concrete from entering from above. Also, neck 54 is a closed geometric shape and closes the region of the form immediately beneath the lid section 32.

As best seen in FIGS. 1, 3 and 6, the lid section 32 includes a pair of semi-circular plates 142, 144 which are secured by respective brackets 146 to a rim engaging ring 148. The ring 148 is split at 150. The plates 142, 144 are split along a line 152 which passes through the plane of split 150. With this construction, the plates 142, 144 may be spread apart to thereby expand the outer dimension of split-ring 148. This shifts split-ring 148 into engagement with the rim 16. Conversely, by moving the plates 142, 144 toward one another, the outer dimension of split-ring 148 is reduced. This releases the rim 16. To hold the ring 148 in its expanded position, a flange 154 is mounted to the plate 142. The flange 154 is provided with an elongated slot 156. In addition, a bracket 160 is mounted to the plate 144 and carries a bolt 158 which extends through the slot 156. When the plates 142, 144 are spread apart, bolt 158 is tightened to hold the plates in their expanded position and grip the rim 16. Each of the plates 142, 144 have portions removed to provide a central rectangular opening 162. Access through opening 162 to the interior of the form 10 and to the key section 18 is thus achieved. As can be seen from FIGS. 2 and 6, bolts secured by wing nuts, some of which are indicated at 164, secure the plates 142 and 144 to the key section 18.

Figure 4:
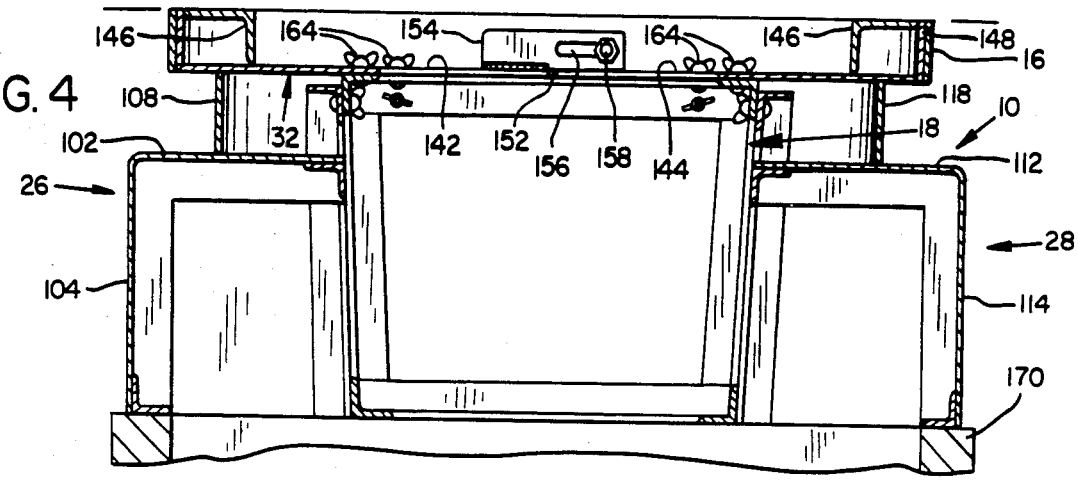
FIG. 4 is a vertical sectional view of the form of FIG. 2, taken along lines 4—4 of FIG. 2.

With reference to FIGS. 4 and 5, it can be seen that the form 10 is supported by walls 170 of a previously installed catch basin. The form 10 is thus designed to provide a curb inlet drain leading to the catch basin. Form 10 facilitates the formation of the curb inlet drain while minimizing the risk of concrete flowing into and plugging the catch basin.

With reference to FIG. 5, the spacer mechanism 50, which is identical to the mechanisms 72 and 92 (FIG. 3) is illustrated in greater detail. This mechanism comprises a tab or bar 50 pivoted at one end 172 to a web located at the underside of the shelf 44. When positioned as shown in FIG. 5, bar 50 maintains the spacing between the lower curved flange 48 and the shelf 44. In this manner, a mouth of uniform size is formed when the curb inlet drain is poured.

In addition, the form elements 20, 22 and 24 include nosing retainer or clamping assemblies 176 (FIG. 5) for holding the nosings 114 in the desired position while concrete is poured. The illustrated mechanism 176 includes a base 178 pivotally mounted at one end by pivot 179 to the web . An arcuate finger 180 extends upwardly from one end of base 178, through openings 181 in shelf 44 and 182 in neck segment 52, and into engagement with the nosing 14. After the concrete is poured and sets for a short period of time, the finger 180 is retracted into the form by pulling on a lever 182. Access to the lever, as well as to the bar 50, is provided through the throat or mouth 15 of the form. With the illustrated mechanism 176, the nosing may be moved toward or away from the lid section 32 to a desired position and then held in place. Also, alternate sized and shaped nosings may readily be used. As a result, different nosings may be easily be accommodated and also different spacings between the face of the nosing and curb may be readily established.

The elements utilized in manufacturing the form 10 are of a strong durable material. Suitable examples, which are not intended to be limitations, include injection molded plastics, expanded polystyrene, polyethylene, fiberglass, cast aluminum, cast iron, magnesium, stainless steel, wood, and other materials.

In use, the form 10 is assembled by attaching the form elements 20 through 30 to the sides of key section 18 and also the lid section 32 to the key section. In addition, the rim 16 and nosing 14 are positioned on the form. When in position, the nosing retainer mechanisms 176 are operated to engage the nosing 14 and the split ring 148 is expanded to engage the rim 16.

When so assembled, the form is sprayed lightly with a concrete releasing oil to prevent concrete from sticking to the contact surfaces of the form. The form is then placed over a catch basin, curved elements 96, 98 are positioned (see FIG. 6) as desired, and concrete is poured. After the concrete has set for a short period of time, the form is then removed for use in forming another curb inlet drain.

To accomplish this removal, the lid section 32 is first removed. This is accomplished by loosening the bolt 158 and also the bolts which secure the lid section 32 to the key section 18. Following this, the lid section is removed. Then, all of the bolts securing the elements 20 through 30 to the key section 18 are removed. In addition, the nosing retainer mechanisms 176 are disengaged by reaching inside the mouth 15 or throat of the form and pulling on levers 182. The key section 18 is then lifted upwardly out of the curb inlet drain. Thereafter, the spacing bars 50 are pivoted inwardly toward the center of the form. Then, the central front form element 20 is pushed inwardly into the center of the form, downwardly, and then lifted up and out. The tapered shelf 44 and tapered lower flange 48 enables the element 20 to be pulled free from corner elements 22, 24 without binding. The rear form element 30 is removed in a similar manner. The tapered shelf 124 of element 30 enables it to be easily pulled free of the side elements 26, 28. Thereafter, the front corner drain forming elements 22 and 24 are pushed slightly sideways, inwardly, downwardly and are lifted upwardly and out from the curb inlet drain. At this point, the side drain forming elements 26, 28 are easily slid in, downwardly and lifted out through the manhole opening.

The form is then cleaned, for example hosed down with water, to remove all foreign material. Then, the form is reasssembled. Following reassembly, the form is ready for reuse in manufacturing the next curb inlet drain. The entire removal and reassembly process takes only approximately fifteen minutes to one-half hour or less.

Having illustrated and described the principles of my invention with reference to one preferred embodiment, it should be apparent to those persons skilled in the art that such invention may be modified in arrangement and detail without departing from such principles. I claim as my invention all such modifications as come within the true spirit and scope of the following claims.

I claim:

1. A reusable concrete crub inlet drain form for forming a curb inlet drain for a catch basin comprising:

a central key section means having a top, a bottom, and sides;

plural curb inlet drain forming means detachably mounted to the sides of the central key section for forming the upper portion of a curb inlet drain;

the curb inlet drain forming means each including a rear wall for detchable mounting to a side of the key section means, a shelf which is generally horizontal, a flange projecting downwardly from a outer edge of the shelf, and a neck segment flange projecting upwardly from the shelf; and the curb inlet drain forming means including means for forming a drain inlet opening leading to the catch basin.

2. The apparatus of claim 1 in which the curb inlet drain forming means comprises means for forming a rectangular box form when mounted to the sides of the key section means.

3. The apparatus of claim 1 in which the sides of the key section means slope inwardly from top to bottom.

4. The apparatus of claim 1 in which the key section means comprises a hollow frame which is open at the top and which is in the shape of an inverted truncated four-sided pyramid.

5. The apparatus of claim 1 in which the neck segment flanges form an enclosed geometric shape when the curb inlet drain forming means are mounted to the key section means.

6. The apparatus of claim 5 in which the geometric shape comprises a circle.

7. The apparatus according to claim 1 in which the curb inlet drain forming means comprise a front central drain forming element, first and second front corner drain forming elements, first and second side drain forming elements and a rear drain forming element.

8. The apparatus according to claim 7 in which the front and rear drain forming elements taper moving downwardly from their respective walls.

9. The apparatus of claim 1 further including lid section means detachably mounted to the top of the key section means, the lid section means including means for selectively engaging and supporting a manhole supporting rim while the curb inlet drain is formed.

10. The apparatus of claim 1 in which the curb inlet drain forming means includes means for releasably mounting a nosing to the form.

11. A reusable concrete curb inlet drain form for forming a curb inlet drain for a catch basin comprising:

a central key section means having a top, a bottom and sides;

plural curb inlet drain forming means detachably mounted to the sides of the central key section for forming the upper portion of a curb inlet drain;

the curb inlet drain forming means including means for forming a drain inlet opening leading to the catch basin;

lid section means detachably mounted to the top of the key section means, the lid section means including means for selectively engaging and supporting a manhole supporting rim while the curb inlet drain is formed, and in which the lid section means is circular and includes two substantially semicircular plates and split-ring rim engaging means mounted to the periphery of the plates, the plates being movable to expand and contract the split-ring rim engaging means to respectively engage and disengage the manhole supporting rim, and the lid section means including means for selectively fixing the plates relative to one another to thereby fix the split-ring rim engaging means.

12. A reusable concrete curb inlet drain form for forming a curb inlet drain for a catch basin comprising:

a central key section means having a top, a bottom and sides;

plural curb inlet drain forming means detachably mounted to the sides of the central key section for forming the upper portion of a curb inlet drain;

the curb inlet drain forming means including means for forming a drain inlet opening leading to the catch basin, the curb inlet drain forming means comprising a front central drain forming element, first and second front corner drain forming elements, first and second side drain forming elements and a rear drain forming elements; and the front central drain forming element and first and second front corner drain forming elements each including an associated means for releasably mounting a nosing to the form, each of such last named means comprising a base pivoted to the underside of the shelf of an associated drain forming element, an upwardly extending arcuate finger mounted to the base and projecting upwardly and forwardly through a hole in the shelf of the associated drain forming element, and lever means connected to the base for pivoting the base to move the arcuate finger forwardly and into engagement with a nosing resting on the shelf of the associated drain forming element and to move the finger rearwardly to release the finger from the nosing.

13. The apparatus of claim 12 in which the front central drain forming element and first and second front corner drain forming elements each include a curve lower mouth forming flange for forming the lower region of the drain inlet opening and spacer bar means movable from a first position extending from the underside of the shelf to the upper surface of the lower mouth forming flange means to other position in which the spacer bar means does not extend between the underside of the shelf and upper surface of the lower mouth forming flange means.

14. The apparatus of claim 13 in which the front and rear drain forming elements taper moving outwardly from the respective walls.

15. A reusable concrete curb inlet drain form for forming a curb inlet drain for a catch basin comprising:

a central key section means having a top, a bottom and sides;

plural curb inlet drain forming means detachably mounted to the sides of the central key section for forming the upper portion of a curb inlet drain;

the curb inlet drain forming means including means for forming a drain inlet opening leading to the catch basin, the curb inlet drain forming means comprising a front central drain forming element, first and second front corner drain forming elements, first and second side drain forming elements and a rear drain forming element; and the front central drain forming element and first and second front corner drain forming elements each including a curved lower mouth forming flange for forming the lower region of the drain inlet opening and spacer bar means movable from a first position extending from the underside of the shelf to the upper surface of the lower mouth forming flange means to other positions in which the spacer bar means does not extend between the underside of the shelf and upper surface of the lower mouth forming flange means.

16. A reusable concrete curb inlet drain form for forming a curb inlet drain for a catch basin comprising:

a central key section means having a top, a bottom and sides, the key section means comprising a frame in the shape of an inverted truncated four-sided pyramid;

plural curb inlet drain forming means detachably mounted to the sides of the central key section means for forming the upper portion of a curb inlet drain;

the curb inlet drain forming means comprising a front central drain forming element, first and second front corner drain forming elements, first and second side drain forming elements, and a rear drain forming element, each of the drain forming elements including a respective rear wall for detachably mounting to a side of the key section means, a shelf which is generally horizontal, a flange projecting downwardly from the outer edge of the shelf, and a neck segment flange projecting upwardly from the shelf, the neck segment flanges forming an enclosed geometric shape when the curb inlet drain forming elements are mounted to the key section means;

the front and rear drain forming elements being tapered in a direction moving outwardly from the respective rear walls;

the front central drain forming element, and first and second front corner drain forming elements each including a lower mouth forming flange means for forming the lower region of a curb inlet drain opening leading to the catch basin, the shelves and downwardly projecting flanges of the front central drain forming element and first and second front corner drain forming elements forming the upper regions of the drain inlet opening;

the front central drain forming element and first and second front corner drain forming elements each including an associated spacer bar means movable from a first position extending from the underside of the shelf of the associated drain forming element to the upper surface of the lower mouth forming flange means of the associated drain forming element to other positions in which the spacer bar means does not extend between the underside of the shelf of the associated drain forming element and upper surface of the lower mouth forming flange means of the associated drain forming element;

the front central drain forming element and first and second front corner drain forming elements each including an associated means for releasably mounting a nosing to the form, each of such last named means comprising a base pivoted to the underside of the shelf of the associated drain forming element, an upwardly extending arcuate finger mounted to the base and projecting upwardly and forwardly through an opening in the shelf of the associated drain forming element, a lever means connected to the base for pivoting the base to move the arcuate finger forwardly and into engagement with the nosing resting on the shelf of the associated drain forming element and to move the finger rearwardly to release the finger from the nosing;

the curb inlet drain forming elements forming a rectangular box-like structure when mounted to the sides of the key section means;

the apparatus further including lid section means detachably mounted to the top of the key section means, the lid section means including means for selectively engaging and supporting a manhole supporting rim while the curb inlet drain is formed, the lid section means being generally circular and including first and second substantially semi-circular plates and split-ring rim engaging means mounted to the periphery of the plates, the plates being movable to expand and contract the split-ring rim engaging means to respectively engage and disengage the manhole supporting rim, and the lid section means including means for selectively fixing the plates relative to one another to thereby fix the split-ring rim engaging means.

* * * * *